United States Patent [19]

Ristow

[11] Patent Number: 4,519,172

[45] Date of Patent: May 28, 1985

[54] WATERPROOF ROOF

[76] Inventor: Delano H. Ristow, 10015 Steinthal Rd., Kiel, Wis. 53042

[21] Appl. No.: 481,245

[22] Filed: Apr. 1, 1983

[51] Int. Cl.[3] ..... E04B 7/00

[52] U.S. Cl. ..... 52/96; 52/465

[58] Field of Search ..... 52/94, 96, 63, 272, 52/273, 287, 288, 459–465; 160/392, 395; 403/205, 231

[56] References Cited

U.S. PATENT DOCUMENTS

| | | | |
|---|---|---|---|
| 141,929 | 8/1873 | Hegeler et al. . | |
| 164,602 | 6/1875 | Shepard | 52/94 |
| 459,980 | 9/1891 | Taylor | 52/466 |
| 502,009 | 7/1893 | Neel . | |
| 844,056 | 2/1907 | Taylor | 52/459 |
| 910,080 | 1/1909 | Moyer . | |
| 980,089 | 12/1910 | Ford . | |
| 1,169,240 | 1/1916 | Coleman | 52/463 |
| 1,218,600 | 3/1917 | Fardon . | |
| 1,327,770 | 1/1920 | Norton . | |
| 1,447,175 | 3/1923 | Henderson . | |
| 1,615,105 | 1/1927 | Williams et al. | 52/96 |
| 2,140,691 | 12/1938 | Crump | 108/13 |
| 2,585,324 | 2/1952 | Hutchisson et al. | 108/26 |
| 2,907,287 | 10/1959 | Trostle | 52/463 |
| 3,012,376 | 12/1961 | Reddy et al. | 52/96 |
| 3,055,147 | 9/1962 | Goodwin | 50/200 |
| 3,058,518 | 10/1962 | Housman | 160/380 |
| 3,302,350 | 2/1967 | Brown et al. | 52/288 |
| 3,335,537 | 8/1967 | Mackey | 52/463 |
| 3,389,515 | 6/1968 | Hellebrand | 52/94 |
| 3,533,201 | 10/1970 | Tyler | 52/60 |
| 3,738,068 | 6/1973 | Attaway | 52/60 |
| 4,037,372 | 7/1977 | Patry | 52/96 |
| 4,071,987 | 2/1978 | Hickman | 52/94 |
| 4,144,622 | 3/1979 | Yoshinara et al. | 160/395 |
| 4,231,141 | 11/1980 | Derrick et al. | 160/395 |
| 4,241,594 | 12/1980 | Hall et al. | 52/60 |
| 4,424,650 | 1/1984 | Van Note | 52/63 |
| 4,439,956 | 4/1984 | House | 52/60 |

FOREIGN PATENT DOCUMENTS

| | | | |
|---|---|---|---|
| 564239 | 2/1958 | Belgium | 52/466 |
| 661794 | 11/1951 | United Kingdom | 52/288 |

*Primary Examiner*—James L. Ridgill, Jr.
*Attorney, Agent, or Firm*—James Earl Lowe, Jr.

[57] ABSTRACT

A waterproof roof including a generally planar supporting roof structure and an assembly comprising a first elongated member attached to the generally planar supporting roof structure and comprising a raised central portion.

This invention also provides a waterproof roof including a supporting roof structure comprising a planar portion and a side attached to the planar portion and an assembly comprising a first elongated member including a first portion on the planar portion and a second portion on the side, and a raised central portion on the side and connected to the first portion and the second portion.

This invention also provides a waterproof roof including a supporting roof structure comprising a first roof portion, a second roof portion forming a 90° angle with the first roof portion, and a joint connecting the first and the second roof portions. The roof also includes an assembly comprising a first elongated member including a first portion on the first roof portion and a second portion on the second roof portion, and a raised central portion extending across the joint through the 90° angle and connected to the first and the second portions of the first elongated member.

Each of the assemblies also includes a second elongated member with a shape generally conforming to the raised central portion and attached to the raised central portion, and the roof further includes a generally continuous elastic sheathing member covering the supporting roof structure and secured between the first and the second elongated members of the assemblies.

18 Claims, 5 Drawing Figures

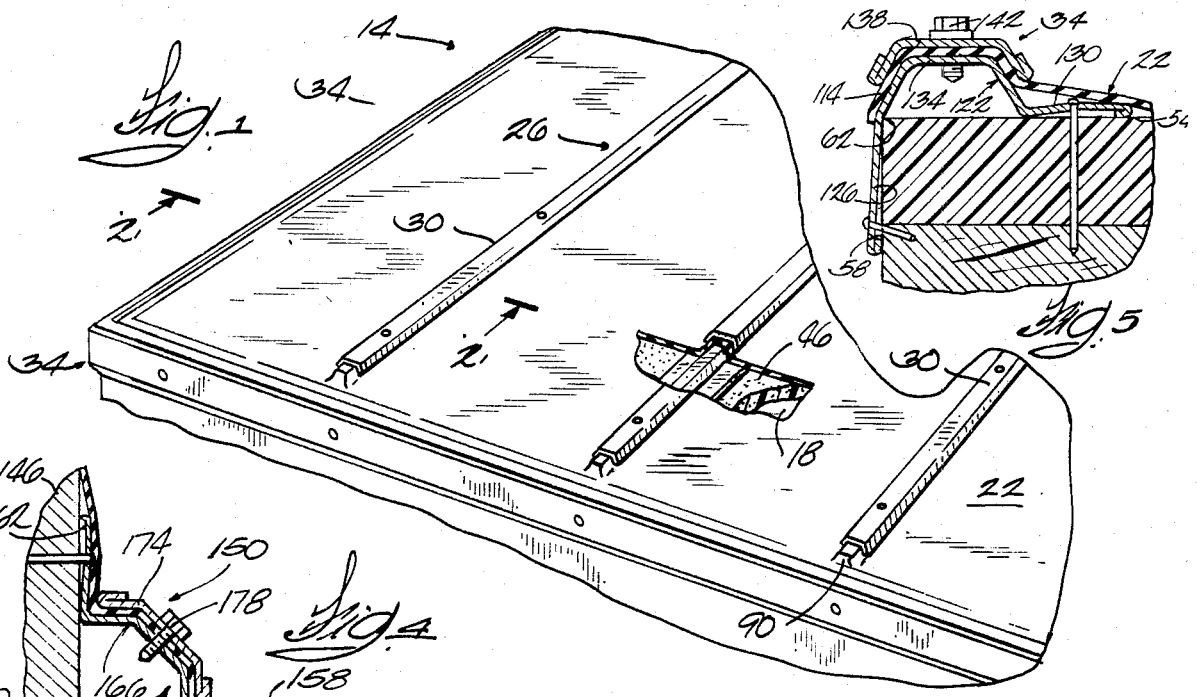
Fig. 1
Fig. 5
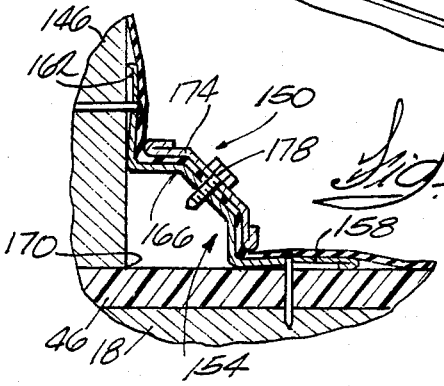
Fig. 4
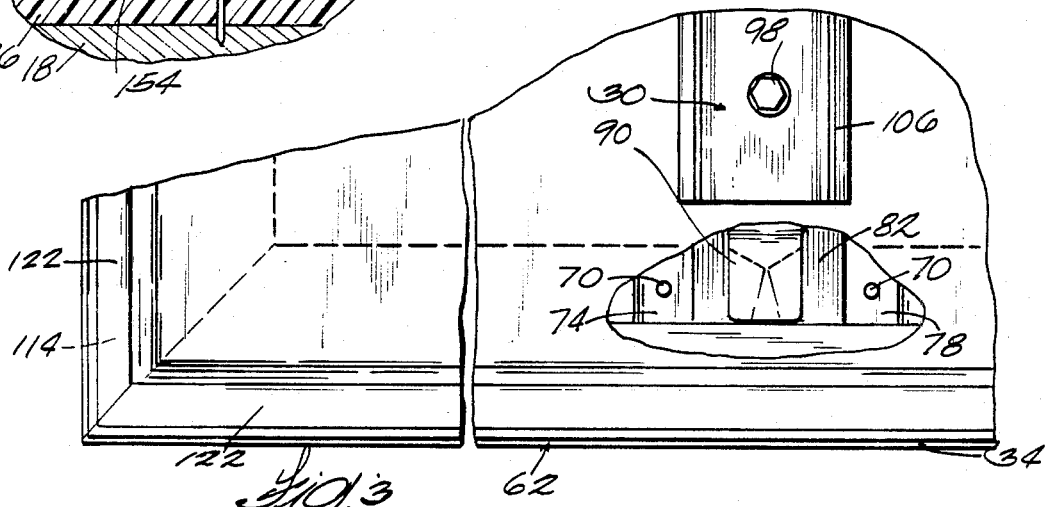
Fig. 3
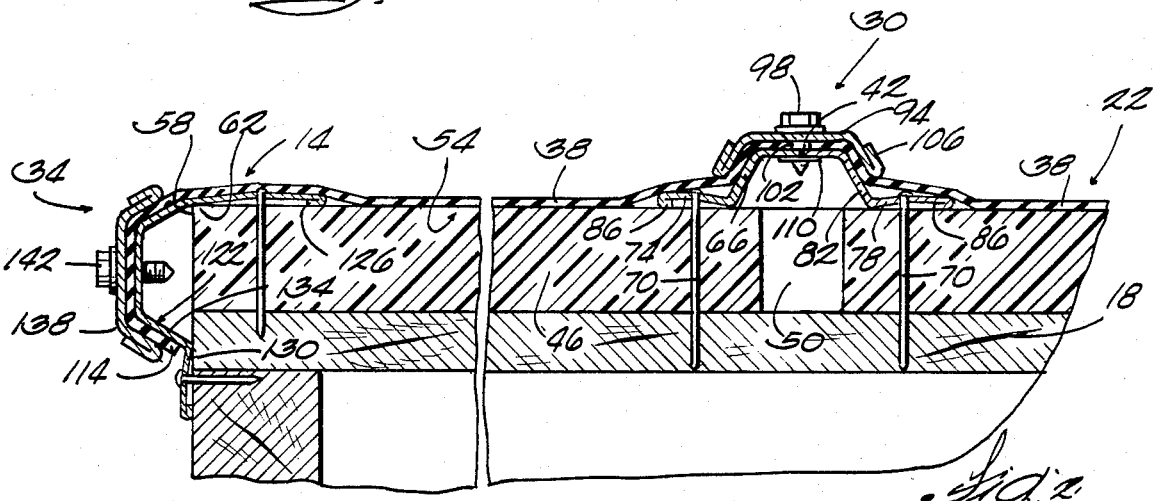
Fig. 2

WATERPROOF ROOF

BACKGROUND OF THE INVENTION

This invention relates to waterproof roofs, and, more particularly, to roofs including a generally elastic sheathing member secured to a supporting roof structure.

Attention is directed to the following U.S. patents which disclose means for securing metal plates to supporting rafters.

| Patentee | U.S. Pat. No. | Issue Date |
|---|---|---|
| T. H. Williams et al | 1,615,105 | Jan. 18, 1927 |
| M. A. Shepard | 164,602 | June 15, 1875 |

Current means for securing elastic sheathing members to supporting roof structures comprises elongated members which are arranged in spaced relationship over the sheathing member. The elongated members are secured to the supporting roof structure through the sheathing members covering the roof structure. In order to waterproof the roof, strips of sheathing material must then be secured over the elongated member. This practice is both time consuming and expensive because three glue seams (one connecting edges of separate sheathing member segments and the two securing the overlying strip) are required. A securing means requiring a single seam connecting edges of separate sheathing member segments requires less glue and less labor and reduces the likelihood of installation errors.

SUMMARY OF THE INVENTION

This invention provides a waterproof roof including a generally planar supporting roof structure. The roof also includes an assembly comprising a first elongated member attached to the generally planar supporting roof structure and comprising a raised central portion, and a second elongated member with a shape generally conforming to the raised central portion and attached to the raised central portion, and a generally continuous elastic sheathing member covering the supporting roof structure and secured between the first and the second elongated members of the assembly.

In one embodiment, the waterproof roof incudes a plurality of the assemblies in spaced relationship and the sheathing member comprises a plurality of sheathing segments between pairs of assemblies. The sheathing segments include edges joined to one another between the first and second elongated members of the assemblies.

In one embodiment, the raised central portion forms an inverted truncated V.

This invention also provides a waterproof roof including a supporting roof structure comprising a planar portion and a side attached to the planar portion. The roof also includes an assembly comprising a first elongated member including a first portion on the planar portion, a second portion on the side, and a raised central portion on the side and connected to the first portion and the second portion. The assembly also includes a second elongated member with a shape generally conforming to the raised central portion and attached to the raised central portion, and the roof further includes a generally continuous elastic sheathing member covering the supporting roof structure and secured between the first and the second elongated members of the assembly.

This invention also provides a waterproof roof including a supporting roof structure comprising a first roof portion, a second roof portion forming a 90° angle with the first roof portion, and a joint connecting the first and the second roof portions. The roof also includes an assembly comprising a first elongated member including a first portion on the first roof portion and a second portion on the second roof portion, and a raised central portion extending across the joint through the 90° angle and connected to the first and the second portions of the first elongated member. The assembly also includes a second elongated member with a shape generally conforming to the raised central portion and attached to the raised central portion, and the roof further includes a generally continuous elastic sheathing member covering the supporting roof structure and secured between the first and the second elongated members of the assembly.

One of the principal features of this invention is the provision of means for securing an elastic sheathing member to a roof structure which only requires seams to connect separate sheathing member segments together. The securing means does not require the use of a separate strip of sheathing material over an elongated member, thus saving labor and material.

Another of the principal features of the invention is the provision of such a securing means which is simple to install and more reliable than current securing means.

Another of the principal features of the invention is the provision of means for securing an elastic sheathing member to a supporting roof structure which securing means helps to eliminate any slack in or buckling of the elastic sheathing member.

Other features and advantages of embodiments of the invention will become apparent upon reviewing the following drawings, the detailed description and the appended claims.

BRIEF DESCRIPTION OF THE DRAWINGS

FIG. 1 is a partial perspective view partially in section of a waterproof roof which embodies various of the features of the invention.

FIG. 2 is a cross-sectional view of the roof taken along the line 2—2 in FIG. 1.

FIG. 3 is a top view partially in section of a corner of the roof shown in FIG. 1.

FIG. 4 is a cross-sectional view of a portion of a waterproof roof which embodies various of the features of the invention.

FIG. 5 is a cross-sectional view of a portion of a waterproof roof which embodies various of the features of the invention.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF PREFERRED EMBODIMENTS

As illustrated in FIG. 1, this invention provides a waterproof roof 14 including a supporting roof structure 18. The waterproof roof 14 also includes a generally continuous elastic sheathing member 22 and means 26 for securing the generally continuous elastic sheathing member 22 to the supporting roof structure 18.

The securing means 26 includes a plurality of first and second assemblies 30 and 34 respectively. The first assemblies 30 are placed in parallel relationship at regular intervals along the extent of the supporting roof structure 18 and thereby provide efficient means for securing the sheathing member 22 to the roof structure 18.

The supporting roof structure 18 can be generally horizontal, as shown in FIG. 1, or inclined or domed. The contour of the supporting roof structure 18 and wind uplift considerations determine the arrangement and spacing of the first assemblies 30 and second assemblies 34. The arrangement of the first and second assemblies 30 and 34 respectively can also be employed to assist or resist water drainage from the roof 14.

The sheathing member 22 is elastic so as to provide a flexible waterproof means for preventing water infiltration through the roof structure. The sheathing member 22 can be made of either ethylene propylene dioxide methane (epdm) or poly vinyl chloride (pvc), or any other suitable material for elastic membranes, the choice of material depending on the conditions expected for the waterproof roof 14. The sheathing member 22 can also be reinforced with mesh (not shown), if desired.

The sheathing member 22 includes a plurality of sheathing member segments 38 which are attached at their edges 42 to one another by using an appropriate glue or other connecting means. The edges 42 of the sheathing member segments 38 come together in the first assemblies 30 so the connection joints of the segment edges 42 are protected and reinforced by being lodged in the first assemblies 30. The edges 42 will usually be overlapped to facilitate their connection.

The supporting roof structure 18 can be any material suitable for a roof 14 and can include an overlying layer of insulation panels 46. As illustrated in FIG. 2, the first assemblies 30 can also provide a convenient means for covering gaps 50 between adjacent insulation panels 46 on the roof structure 18.

The supporting roof structure 18 is generally flat or horizontal in this embodiment, although the roof construction can also be used on inclined roofs, especially where water puddling is expected to occur. The supporting roof structure 18 includes a horizontal planar portion 54 and a downwardly extending, perpendicular side 58 attached to the horizontal planar portion 54. The downwardly extending side 58 forms an edge 62 of the generally flat roof 14. Other roof edges are formed in a similar fashion.

Each of the first assemblies 30 includes a first elongated member 66 which is secured to the supporting roof structure 18 at regular intervals using conventional means, such as wood screws 70. The first elongated member 66 includes a first portion 74 and a second portion 78, both of which are attached to the planar portion 54 of the supporting roof structure 18 through the insulation 46. The first elongated member 66 also includes a raised central portion 82 connecting the first 74 and second 78 portions to provide a point of attachment above the plane of the horizontal roof structure 18 for the sheathing member 22. Although various forms are possible for the raised central portion 82, the raised central portion 82 forms an inverted truncated V in the preferred embodiment.

The first elongated member 66 also includes means 86 for holding the insulation panels 46 in place. In this embodiment, the holding means 86 comprises downwardly inclined outer edges of the first 74 and second 78 portions which are lapped away from the sheathing member 22 to help prevent injury to the sheathing member 22.

The ends 90 of the first elongated member 66 are inclined downwardly towards the edges 62 of the roof structure 18 to provide a smooth transition from the raised central portion 82 of the first elongated member 66 down towards the edge 62 of the roof 14 to remove any abrupt line changes which might cause a puncture in the sheathing member 22.

Each of the first assemblies 30 also includes a second elongated member 94 with a shape generally conforming to the raised central portion 82 of the first elongated member 66. The second elongated member 94 cooperates with the first elongated member 66 to secure the sheathing member 22 to the supporting roof structure 18. The generally continuous elastic sheathing member 22 is placed between the first 66 and second 94 elongated members of the first assembly 66, and the second elongated member 94 is attached at regular intervals to the raised central portion 82 of the first elongated member 66 by conventional means, such as gasketed sheet metal screws 98. The second member 94 can include predrilled holes 102 at regular intervals to assist in the attaching of the second elongated member 94 to the first elongated member 66.

The first 66 and second 94 elongated members are preferably made of galvanized sheet metal because of its ease in shaping and cost savings, although other materials can be used.

The second elongated member 94 also provides means for snugly securing the sheathing member 22 to the roof 14 by virtue of the flexibility of the second elongated member 94. When the sheathing member segments 38 are assembled on the supporting roof structure 18, buckling or waves in the sheathing member 22 are likely to occur. When the second elongated member 94 is attached to the first elongated member 66, the second member 94 pulls the sheathing member 22 into the first assembly 30 thus taking up any slack in the sheathing member 22.

As shown in FIG. 2, the edges 106 of the second elongated member 94 hold the sheathing member 22 adjacent but above the first 74 and second 78 portions of the first elongated member 66. As the sheathing member 22 expands and contracts with varying weather conditions, any slack in the sheathing member 22 can be taken up by the second elongated member 94, thereby keeping the sheathing member 22 in a taut condition. The edges 106 of the second elongated member 94 are also lapped away from the sheathing member 22 in order to prevent damage to the sheathing member 22.

Each of the first assemblies 30 also includes means 110 for further preventing water from entering through the openings in the sheathing member 22 made by the sheet metal screws 98. In the preferred embodiment, this means 110 comprises waterproof caulking or tape attached to the underside of the second elongated member 94, although the caulking or tape can be attached to the top side of the raised central portion 82 of the first elongated member 66. The waterproofing caulking or tape is preferred in situations where deep puddling of water on the waterproof roof 14 is to be expected.

The second assembly 34 of the waterproofing roof 14 is similar to the first assemblies 30 and is used to attach the outer edge 114 of the sheathing member 22 to the edge 62 of the roof structure 18. Additional second assemblies 34 are provided for other edges of the roof 14, and respective ends 122 of the second assemblies 34 are brought together, as shown in FIGS. 1 and 3, to prevent wind uplifting of the sheathing member 22.

The second assembly 34 includes a first elongated member 122 including a first portion 126 attached to the horizontal planar portion 54 of the supporting roof structure 18 and a second portion 130 attached to the downwardly extending side 58 of the supporting roof structure 18. The first elongated member 122 also includes a raised central portion 134 on the downwardly extending side 58 connecting the first 126 and second 130 portions of the first elongated member 122. Although various forms are possible for the raised central portion 134, the raised central portion 134 forms an inverted truncated V in the preferred embodiment.

The second assembly 34 also includes a second elongated member 138 identical to the second elongated member 94 of the first assembly 30. After the outer edge 114 of the elastic sheathing member 22 is placed between the first 122 and second 138 elongated members of the second assembly 34, the second elongated member 138 is attached to the first elongated member 122 by conventional means, such as gasketed sheet metal screws 142.

In some instances waterproof roofs include dams to prevent water from running off the edges of the roof. In those instances, the first elongated member 122 of the second assembly 34 can be reversed (as shown in FIG. 5) so the first portion 126 is attached to the downwardly extending side 58 of the supporting roof structure 18 and the raised central portion 34 and second portion 130 are attached to the horizontal planar portion 54 of the supporting roof structure 18.

As illustrated in FIG. 4, some roof constructions include an upwardly extending side 146 perpendicular to the generally horizontal planar portion 54 of the roof 14. In this situation, another embodiment 150 of the second assembly 34 includes a first elongated member 154 comprising a first portion 158 attached to the generally horizontal planar portion 54 and a second portion 162 attached to the upwardly extending side 146. The first elongated member 154 also includes a raised central portion 166 connecting the first 158 and second 162 portions and extending across the 90° angle between the upwardly extending side 146 and the generally horizontal planar portion 54 across the joint 170 between the side 146 and the planar portion 54. In this embodiment, the second assembly 150 also includes a second elongated member 174 identical to the second elongated member 94 of the first assembly 30 and attached to the raised central portion 166 using conventional means, such as gasketed sheet metal screws 178. In this embodiment, the outer edge 114 of the elastic sheathing member 22 can be attached to the second portion 162 of the first elongated member 154 by glue or other conventional means.

Various of the features of the invention are set forth in the following claims.

I claim:

1. A waterproof roof including a supporting roof structure, an assembly including a first elongated member supported by said supporting roof structure and including a raised portion, and a second elongated member with a shape generally conforming to said raised portion, a generally continuous elastic sheathing member covering said supporting roof structure and sandwiched between said first and said second elongated members of said assembly, and means for attaching said second member to said raised portion, said attaching means comprising a fastener which extends through said sheathing member and between said second member and said raised portion and which is not connected to said supporting roof structure.

2. A waterproof roof in accordance with claim 1 wherein said raised portion forms an inverted truncated V.

3. A waterproof roof in accordance with claim 1 wherein said supporting roof structure includes an edge, and wherein said first elongated member includes an end inclined downwardly towards said edge.

4. A waterproof roof in accordance with claim 1 wherein said generally continuous elastic sheathing member comprises ethylene propylene dioxide methane.

5. A waterproof roof in accordance with claim 1 wherein said generally continuous elastic sheathing member comprises poly vinyl chloride.

6. A waterproof roof in accordance with claim 1 and further including waterproofing means attached to second elongated member.

7. A waterproof roof in accordance with claim 1 wherein said supporting roof structure includes a planar portion and a side generally perpendicular and attached to said planar portion, and wherein said first elongated member is attached to said side.

8. A waterproof roof in accordance with claim 1 wherein said supporting roof structure includes a plurality of insulation panels including adjacent edges, and wherein said first elongated member spans said insulation panel adjacent edges.

9. A waterproof roof in accordance with claim 1 wherein said attaching means comprises a metal screw.

10. A waterproof roof in accordance with claim 1 and further including a plurality of said assemblies in spaced relationship.

11. A waterproof roof in accordance with claim 2 wherein said sheathing member comprises a plurality of sheathing segments between pairs of said assemblies, said sheathing segments including edges joined to one another between said first and second elongated members of said assemblies.

12. A waterproof roof including a generally planar supporting roof structure, a generally continuous elastic sheathing member covering said supporting roof structure, and means for securing said sheathing member to said generally planar supporting roof structure and for reducing slack in said sheathing member, said securing and slack reducing means comprising a plurality of assemblies in spaced relationship, with each of said assemblies including a first elongated member attached to said generally planar supporting roof structure and including a raised central portion, a second elongated member with a shape generally conforming to said raised central portion and including an outer edge, and means for attaching said second elongated member to said raised central portion so that said generally continuous elastic sheathing member is secured between said first and said second elongated members of said assemblies and is tightened by said second member outer edge bearing against said sheathing member.

13. A waterproof roof in accordance with claim 12 wherein said attaching means comprises a metal screw.

14. A waterproof roof including a supporting roof structure comprising a generally planar portion and a side attached to said planar portion, an assembly comprising a first elongated member including a first portion on said planar portion, a second portion on said side, and a raised central portion on said side and connected to said first portion and said second portion, and a second elongated member with a shape generally conforming to said raised central portion, a generally continuous elastic sheathing member covering said supporting roof structure and sandwiched between said first and said second elongated members of said assembly, and means for attaching said second member to said raised portion, said attaching means comprising a fastener which extends through said sheathing member and between said second member and said raised portion and which is not connected to said supporting roof structure.

15. A waterproof roof in accordance with claim 12 wherein said side is generally perpendicular to said planar portion.

16. A waterproof roof in accordance with claim 14 wherein said attaching means comprises a metal screw.

17. A waterproof roof including a supporting roof structure comprising a first roof portion, a second roof portion forming an angle with said first roof portion, and a joint connecting said first and said second roof portions, an assembly comprising a first elongated member including a first portion on said first roof portion and a second portion on said second roof portion, and a raised central portion extending across said joint through said angle and connected to said first and said second portions of said first elongated member, and a second elongated member with a shape generally conforming to said raised central portion, a generally continuous elastic sheathing member covering said supporting roof structure and sandwiched between said first and said second elongated members of said assembly, and means for attaching said second member to said raised portion, said attaching means comprising a fastener which extends through said sheathing member between said second member and said raised portion and which is not connected to said supporting roof structure.

18. A waterproof roof in accordance with claim 17 wherein said attaching means comprises a metal screw.

* * * * *